United States Patent [19]

McCardle

[11] Patent Number: 4,611,521

[45] Date of Patent: Sep. 16, 1986

[54] CHAIN SAW ATTACHMENT

[76] Inventor: Gordon R. McCardle, 9 Tripoli Road, Panmure, Auckland, New Zealand

[21] Appl. No.: 620,079

[22] Filed: Jun. 12, 1984

[30] Foreign Application Priority Data

Jun. 13, 1983 [NZ] New Zealand ..... 204533

[51] Int. Cl.[4] ..... B27B 17/08

[52] U.S. Cl. ..... 83/796; 30/382; 83/574

[58] Field of Search ..... 83/574, 796; 30/382

[56] References Cited

U.S. PATENT DOCUMENTS

| | | | |
|---|---|---|---|
| 2,463,860 | 3/1949 | Foster | 83/574 X |
| 2,851,067 | 9/1958 | Greenslate | 83/574 X |
| 3,154,120 | 10/1964 | Lesher | 83/574 X |
| 4,123,957 | 11/1978 | Niemela et al. | 83/574 X |
| 4,214,498 | 7/1980 | Zukas et al. | 83/574 X |
| 4,283,980 | 8/1981 | Jackson | 83/574 X |
| 4,307,640 | 12/1981 | Michael | 83/574 |
| 4,350,067 | 9/1982 | Picard | 83/796 |

FOREIGN PATENT DOCUMENTS

| | | | |
|---|---|---|---|
| 62188 | 10/1982 | European Pat. Off. | 83/796 |
| 2440818 | 7/1980 | France | 83/574 |

*Primary Examiner*—Frank T. Yost

*Attorney, Agent, or Firm*—Young & Thompson

[57] ABSTRACT

An attachment for a chain saw has a bracket to be bolted to the cutting bar of the saw so that a pivot arm extends on either side of the bracket providing a multi-purpose safety bar for the saw. The pivot arm fits in a support frame enabling the saw to be used for cross-cutting, ripping, or radial cuts.

4 Claims, 6 Drawing Figures

52
53
49
36
50
44
70
71
60
62
64
63
67
68
66
41
51
38

CHAIN SAW ATTACHMENT

This invention relates to a chain saw attachment, and has particular application to a means whereby a chain saw can be held in a variety of positions to cut timber or the like.

Chain saws were developed as a portable means for cutting timber, and have proved to be useful and versatile tools. However, when hand held, they can be dangerous to use, and the weight of the chain saw combined with its power can be a disadvantage where the chain saws are held in the hand for considerable period of time.

Various attachments have been proposed for converting chain saws into mills for cutting timber, including U.S. Pat. Nos. 3,864,830; 4,173,240; and 4,244,104. These however restrict the use of the saw to ripping along a log and have to be dismantled for normal free hand use of the saw.

It is an object of this invention to provide an improved chain saw attachment, or which will at least provide the public with a useful choice.

In one aspect the invention provides an attachment for a chain saw having a cutting bar including a bracket adapted to be secured by fasteners to said cutting bar to a pivot arm extending from either side of said bracket in a line substantially orthogonal to the major axis of said cutting bar and below said fasteners, whereby in use said pivot arm can act as a guard to reduce the risk of operator injury with a hand-wielded chainsaw, or alternatively can be releasably mounted on a support frame.

This enables the saw to be used free hand with the pivot arm providing a multi-purpose safety bar. Moreover, by inserting the pivot arm in an associated support frame the saw can be used for cross-cutting, ripping, and also in some embodiments' for radial cuts as well.

Figure 1:
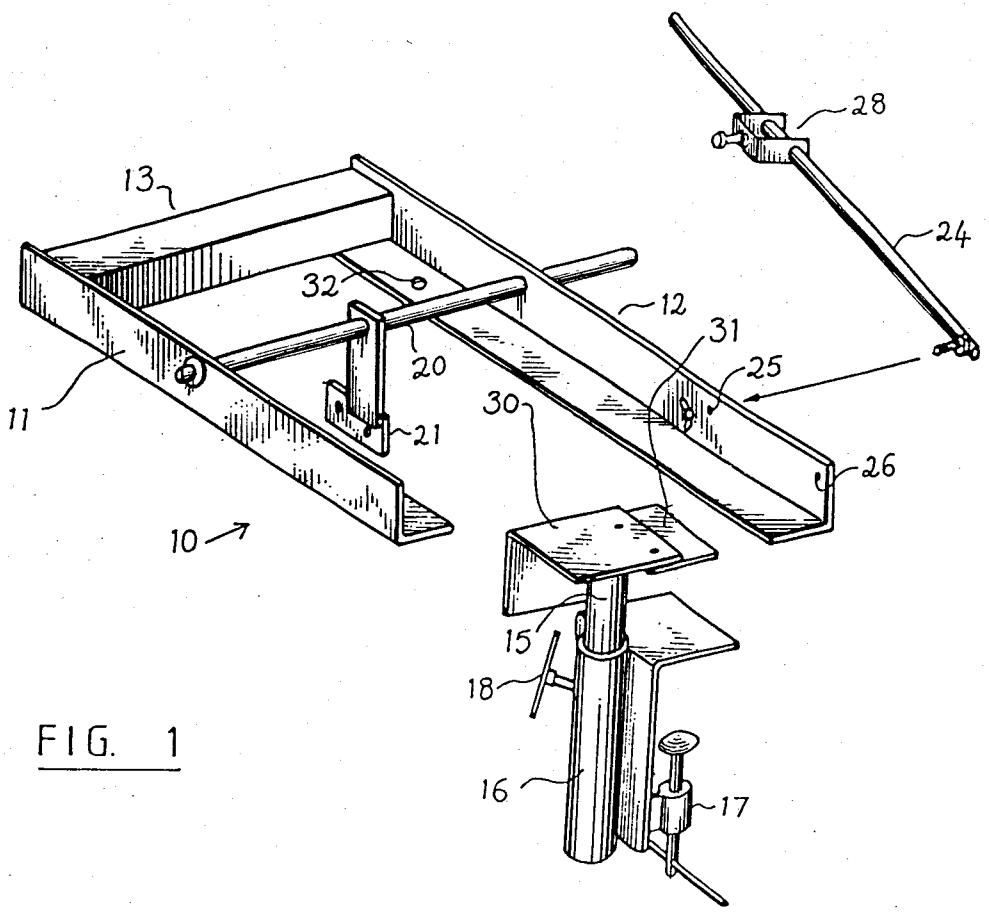

Other aspects of this invention which should be considered in all its novel aspects, will become apparent from the following description which is given by way of example only, with reference to the accompanying drawings in which:

FIG. 1: illustrates an assembly view of the components making up a first chain saw support frame and pivot arm combination.

Figure 2:
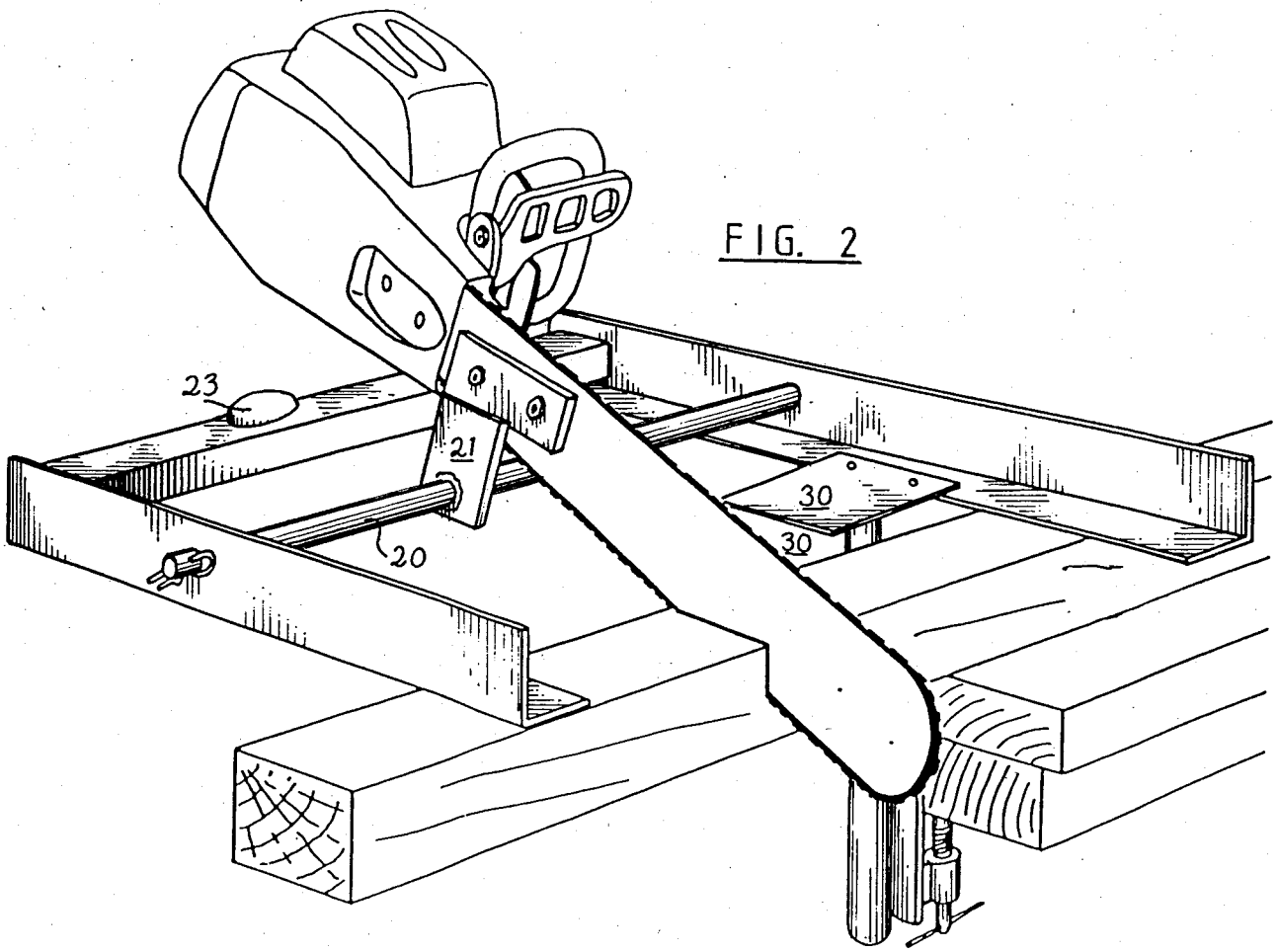

FIG. 2: is a perspective view of a chain saw mounted on the chain saw support frame of FIG. 1.

Figure 3:
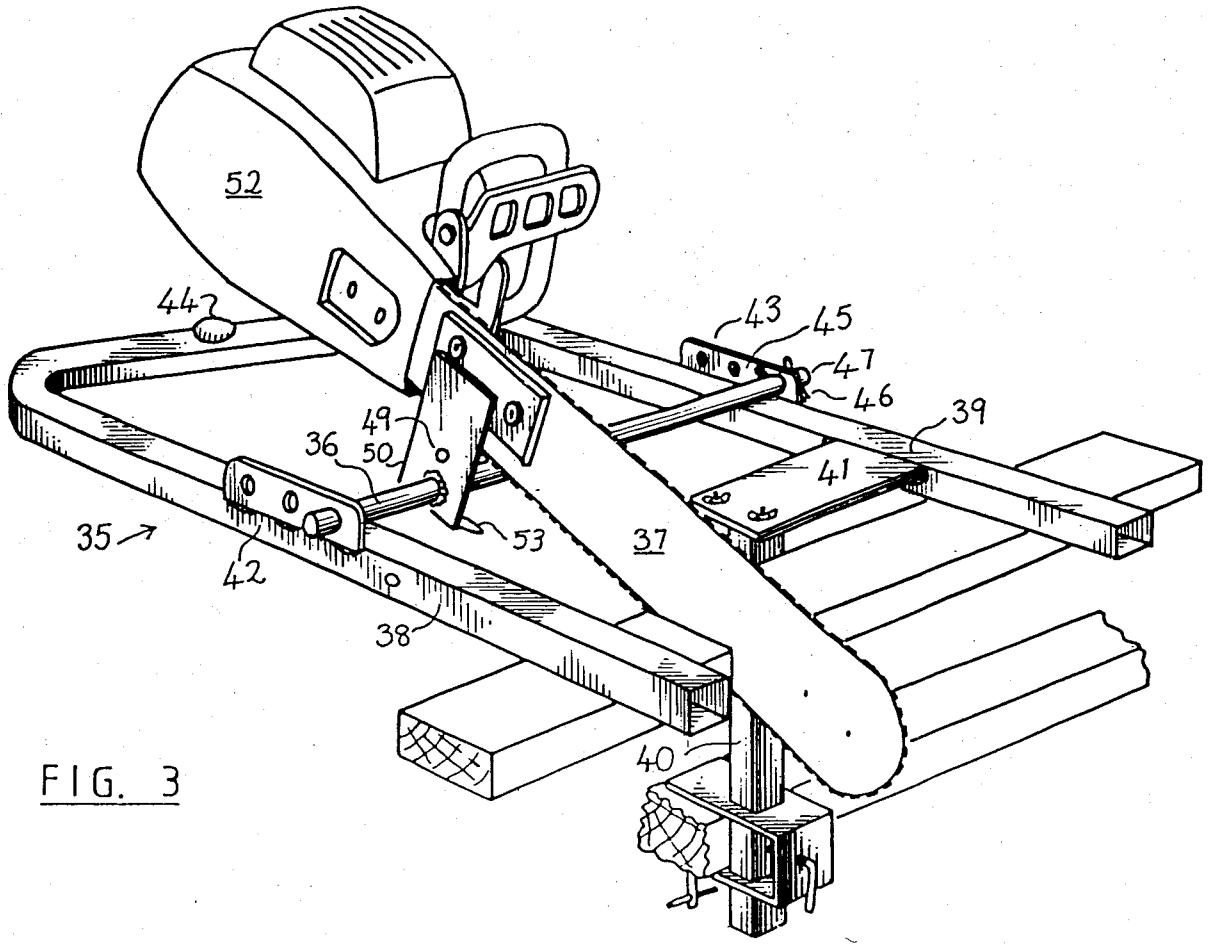

FIG. 3: shows a second model, with saw attached.

Figures 4, 5, 6:
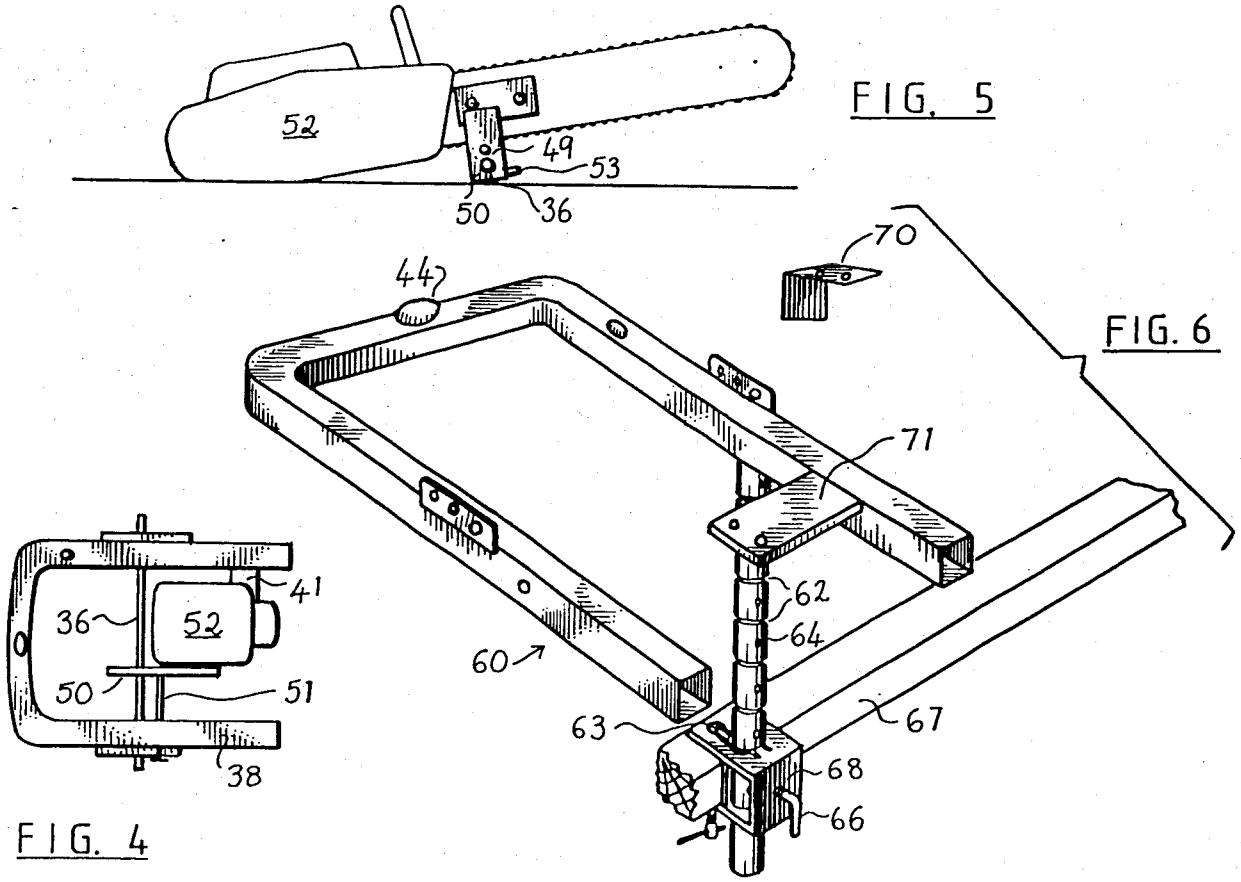

FIG. 4: is a top plan view of the saw mounted vertically for ripping.

FIG. 5: shows the saw with pivot arm attached, resting on the ground.

FIG. 6: shows a third model of support frame.

A first chain saw support shown in FIGS. 1 and 2, has an open, U-shaped, frame 10 having side arms 11 and 12 joined by a cross arm 13 at one end thereof, with arm 12 being longer than arm 11 so that a support post 15 may be mounted on the underside of the arm 12 at a point a sufficient distance away from the cross bar 13.

The support post 15 is adapted for use with a mounting tube 16 and associated clamping means 17 enabling this to be clamped onto an appropriate support such as a table, bench, fence, or the like. By this means, the frame 10 may be supported in a radial fashion enabling appropriate adjustment for different cutting operations, either cross cutting, ripping or angled cuts as required, and for enabling height adjustment. The tube and post may have apertures to receive a pin 18 to set the height.

The side arms 11 and 12 are provided with appropriate apertures for the provision of a pivot arm 20 shown bridging the two arms. This pivot arm is preferably removable from the frame, so that it can be readily fitted to a chain saw, and in fact left on the chain saw to provide a multi-purpose safety bar when the saw is not required for use in the frame.

The pivot arm 20 has mounting means 21 in the form of a bracket adapted to be securely attached to the saw. This attachment involving securing the bracket 21 to the cutting bar of the chain saw and this attachment is more preferably achieved by bolting through the bracket and through apertures provided in the bar of the chain saw adjacent the motor housing. This is the preferred arrangement, although it will be appreciated that other means can be provided where the mounting means can be attached directly to the motor housing.

FIG. 2 shows the chain saw mounted in position for cross cutting, and it will be noted that this view shows the provision of cushioning material 23 on the cross member 13, to provide an appropriate rest for the chain saw housing when not required for cutting.

Optionally, a stabilising arm 24 can be provided, and may cooperate with apertures 25, 26 provided in one or other of the side arms 11 or 12, to provide support for the chain saw when held at a particular angle to the horizontal. This stabilising arm 24 can be provided with appropriate mounting means 28 for attachment to the handle or other portion of the chain saw to lock it in place, with the arm 24 attached to the front or rear of the frame.

In use, the chain saw can be attached to the mounting bracket 21, and may then be attached to the frame by suitably positioning the pivot arm 20 into the apertures in the side arm, and providing appropriate securing means to hold the pivot arm in place. A preferred means involves the use of clip pins or the like to enable the pivot arm to be securely held in place, and yet allowing for ease of removal. The frame can be pivoted to the required position for cross cutting, or ripping, or cutting at a particular angle, and the saw can then be readily pivoted on the pivot arm 20, enabling the user to grip the controls of the saw without the need for special linkages or other controls. The saw can thus be operated readily, with the frame and pivot arm taking the weight and thrust of the saw, therby minimising the risk of accidents from operator fatigue, kick backs or the like.

Many modifications may be made to the foregoing description and it will be appreciated that the length of side arm 11 can be relatively short, as it need not extend as far as that shown, and may in fact be cut off just beyond the aperture for the pivot arm. The radial post and support tube can be arranged in different configurations, and various means may be provided to lock the post in a particular radial position relative to the support tube 16.

The frame of FIG. 1 is formed from angle members, although other shapes or standard members can be used, as will be apparent from FIGS. 3 and 6.

A back stop 30 can be provided, preferably releasably attachable to a mounting 31 on either or both arms. It is preferably removed when the saw is swung through an arc or when used for ripping. It is shown in the drawings for right handed saw operation (i.e. timber can be held against the back stop by the left hand).

An aperture 32 can be provided in one of the arms so that the saw (with pivot arm attached) can be held on its side for servicing with the arm 20 inserted vertically through the aperture 32. Notches or clips (not shown) may be provided on the frame to hold a sack or bag for filling with firewood after the saw has been removed.

FIG. 3 shows a second model in which the support 35 is formed of box section tubing and is of lesser width than the support of FIG. 2, so that pivot rod 36 can be shorter than rod 20 and hence the saw bar 37 cuts close to arm 38.

The support 35 is mounted on a square post 40 which is releasably attached to plate 41 by bolts or the like passing through apertures in plate 41 to a plate welded to the top of post 40. Plate 41 is welded to arm 39. The square post 40 also acts as a back stop depending from the support plate 41.

The pivot arm 36 is attached to apertured lugs 42, 43 on arms 38, 39. The pivot arm has a protrusion 45 which abuts against the inside of lug 43 whilst a clip pin 46 or the like secures the outer end 47 of the arm.

This model allows the saw to be mounted for cross-cuts as shown, or the post can be turned through 90 degrees for ripping. A resilient buffer 44 is provided for the saw when tilted back into the resting position.

An aperture 49 is provided in the bracket 50 for the reception of a locking pin 51 passing through arm 38 to hold the saw 52 vertically for ripping as shown in FIG. 4.

A bucking spike 53 can be provided on the bracket 50, for use when the saw is used free hand, i.e. removed from the support frame.

The shorter pivot arm of FIG. 3 allows the saw to be quickly and easily inserted into and removed from the support frame 35. To insert the saw, the arm 36 is first pushed through an aperture in lug 42, then the end 47 of arm 36 is lowered into alignment with the corresponding aperture in lug 43 and pushed through until protrusion 45 abuts the lug. Then clip 46 is attached to the outer end 47 to hold the arm in place.

FIG. 5 shows the saw 52 removed from the support frame, with the bracket 50 (and arm 36), helping to keep the saw upright and holding the sump of the saw clear of the ground. This helps protect the sump from wear and damage and tends to keep the air intake and hot enhaust clear of debris. By leaving the bracket and pivot arm permanently mounted on the saw, the saw can be used both free hand and on the support frame. The pivot arm thus provides a multi-purpose safety bar and allows the saw to be hung easily on any wall or post. It guards the user from chainlash (from a broken or jumped chain) as well as guarding the lower body from contact with the running chain.

FIG. 6 shows a third support frame combining the features of FIG. 3 with the radial support post arrangement of FIG. 1. This support frame 60 is mounted on cylindrical post 61 which is grooved at 62 to receive a holding clip 63 to fix the height of frame.

Additionally locating apertures 64 are provided so that the post can be located and locked by pin 66 in the 90 degrees position for cross-cutting.

The post can be attached to an appropriate support, e.g. a bench 67, by clamp 68. If the saw is to be used for ripping logs, the clamp 68 can be attached to a short length of box section tube slidably fitted on a wooden beam mounted on legs above the horizontal log. A removable back stop 70 is shown (above the inwardly support member 71).

Finally, it will be appreciated that various other alternations or modifications may be made to the foregoing without departing from the scope of this invention, as exemplified by the following claims.

I claim:

1. An attachment for a chainsaw having an elongated cutting bar, including a bracket adapted to be secured by fasteners to said cutting bar, a pivot arm extending from either side of said bracket in a line substantially orthogonal to the length of said cutting bar and below said fasteners, whereby in use said pivot arm can act as a guard to reduce the risk of operator injury with a hand-wielded chainsaw, an open support frame having pivot supports on either side thereof for reception of said pivot arm, and a substantially vertical post which can swivel and on which said open support frame is mounted.

2. In combination a chain saw and an attachment as claimed in claim 1, with said bracket secured to the cutting bar of the chain saw by bolts passing through the cutting bar.

3. An attachment as claimed in claim 1 and further including a bucking spike on a forward portion of said bracket.

4. An attachment as claimed in claim 3 wherein said support frame has two side limbs and an end member defining a substantially "U"-shaped frame, and said frame has a back stop support member extending inwardly from one of said side limbs.

* * * * *